United States Patent [19]

Rigby

[11] Patent Number: 4,930,639

[45] Date of Patent: Jun. 5, 1990

[54] OVENABLE FOOD CONTAINER WITH REMOVABLE LID

[75] Inventor: William R. Rigby, Newark, Del.

[73] Assignee: Westvaco Corporation, New York, N.Y.

[21] Appl. No.: 884,770

[22] Filed: Aug. 2, 1989

[51] Int. Cl.[5] ..... B65D 5/54

[52] U.S. Cl. ..... 206/621; 206/625; 206/626; 206/631.1; 279/903

[58] Field of Search ..... 206/620, 621, 625, 626, 206/631, 631.1; 229/902, 903, 905; 426/122

[56] References Cited

U.S. PATENT DOCUMENTS

| | | | |
|---|---|---|---|
| 2,186,973 | 1/1940 | Hothersall | 206/621 |
| 3,167,238 | 1/1965 | Smith | 206/625 |
| 3,357,631 | 12/1967 | Aid et al. | 206/625 |
| 3,572,576 | 3/1971 | Foster | 206/625 |
| 3,580,466 | 5/1971 | Thelen | 206/621 |
| 3,829,004 | 8/1974 | Graser | 229/33 |
| 4,043,503 | 8/1977 | Meyers et al. | 206/625 |
| 4,183,458 | 1/1980 | Meyers | 206/626 |
| 4,312,451 | 1/1982 | Forbes, Jr. | 206/628 |
| 4,436,206 | 3/1984 | Kuchenbecker | 206/621 |
| 4,746,019 | 5/1988 | Prater | 206/625 |
| 4,813,594 | 3/1989 | Brown et al. | 229/903 |
| 4,836,438 | 6/1989 | Rigby | 206/631.1 |

FOREIGN PATENT DOCUMENTS

| | | | |
|---|---|---|---|
| 2058510 | 2/1972 | Fed. Rep. of Germany | 206/620 |
| 1396697 | 6/1975 | United Kingdom | 206/625 |

*Primary Examiner*—Gary Elkins

[57] ABSTRACT

A container for packaging, storing and heating food is prepared from a single blank of paperboard that is coated on at least one side with a thermally stable heat-sealable coating. The container is substantially rectangular in shape and includes upstanding side, front and rear walls connected to a bottom panel, gusset panels at each corner, integral flanges connected to the side walls, an integral lid foldably attached to the rear wall and adapted to be heat-sealed to the side wall flanges, and a front closure flap integral with the lid and adapted to overlap and be sealed to the front wall.

7 Claims, 2 Drawing Sheets

OVENABLE FOOD CONTAINER WITH REMOVABLE LID

BACKGROUND OF INVENTION

The present invention relates generally to the art of food packaging and more particularly to a container for packaging, storing and heating food.

Containers of the type disclosed herein are well known in the art. They are low in cost, disposable and adapted to be used in the preparation of food, particularly with the use of a microwave oven.

Examples of containers substantially as disclosed herein are shown in U.S. Pat. Nos. 3,829,004; 4,183,458; and 4,312,451. The container of the present invention represents an improvement over the prior art containers.

SUMMARY OF INVENTION

According to the present invention, a container is disclosed for the packaging, storing and heating of food which finds particular utility in microwave cooking. The invention comprises a container with an integral, removable lid. The container is preferably constructed from a thermally stable paperboard material that is generally referred to as ovenable paperboard. For this purpose, the paperboard is coated on at least one side with a heat sealable thermoplastic material, for example, a polyester material such as polyethylene terephthalate.

The container comprises a tray and integral lid. The tray includes a base panel of generally rectangular shape and a plurality of upstanding side walls comprising at least two side walls, a front wall and a rear wall. The upstanding side walls may extend perpendicularly from the base panel, or two or more may be angularly related to the bottom panel to achieve a stacking capability. Preferably, the front and rear walls are perpendicular to the base panel and the side walls are angularly related to the base panel for display purposes. The side walls are interconnected at each corner by corner closures in the form of overlapping gusset panels which are bonded to the adjacent side walls to achieve a leak proof tray. This construction provides an interior with no exposed raw edges when the container is prepared from a single blank of paperboard or the like. Each of the opposed side walls further include extensions which are foldably attached to the upper edges thereof to provide side wall flanges at each side of the container. At least one gusset panel at each corner also includes an upper extension which is bonded to the lower surface of the side wall flange attached to its adjacent side wall. In addition, an integral cover or lid is foldably attached to the upper edge of the rear wall for closing the container. The lid panel is sized so as to overlap and be bonded or preferably heat-sealed to the side wall flanges when the container is closed after filling. Moreover, a front closure flap is foldably attached to the leading edge of the lid panel which overlaps and is bonded to the front wall of the container to complete the closure of the container. In order to open the container, the front closure flap is provided with a tear strip or the like, and the sides of the lid overlapping the side wall flanges are provided with inner and outer partial depth microcut lines offset from one another to produce an area of delamination therebetween. The microcuts weaken the paperboard in the area between their application which permits the paperboard in that area to delaminate easily when the lid is lifted. The delamination of the paperboard leaves a portion of the lid still attached to the side wall flanges to further strengthen the container and still allow the user to open the container without undue effort. In the instance where it is desired to remove the lid completely from the container, a line of perforation may be included along the fold line connecting the lid to the rear wall. Finally, a dust flap may also be added to the upper edge of the front wall for the purpose of protecting the contents of the container during closing, and for protecting against inadvertent spills after the container is opened.

Accordingly it may be seen that the present invention provides a unique container that is readily filled and sealed and which may be opened for use in preparing food products.

DETAILED DESCRIPTION

Figure 2:
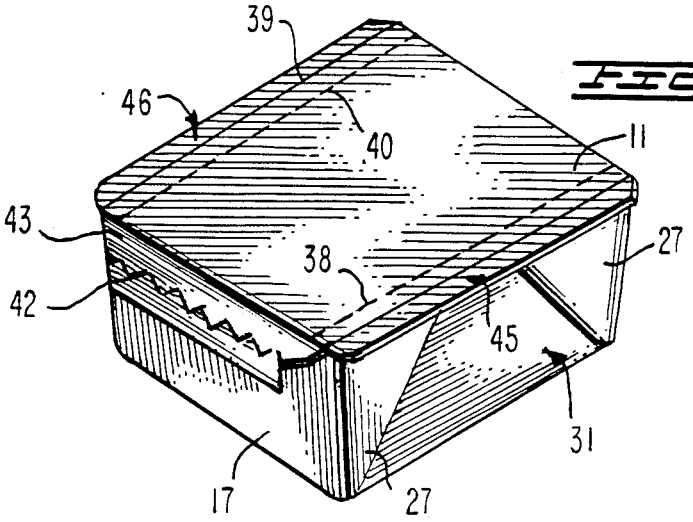
FIG. 2 is a perspective view of a sealed container made from the blank of FIG. 1; and, FIG. 3 is a perspective view of an opened container.
Figure 3:
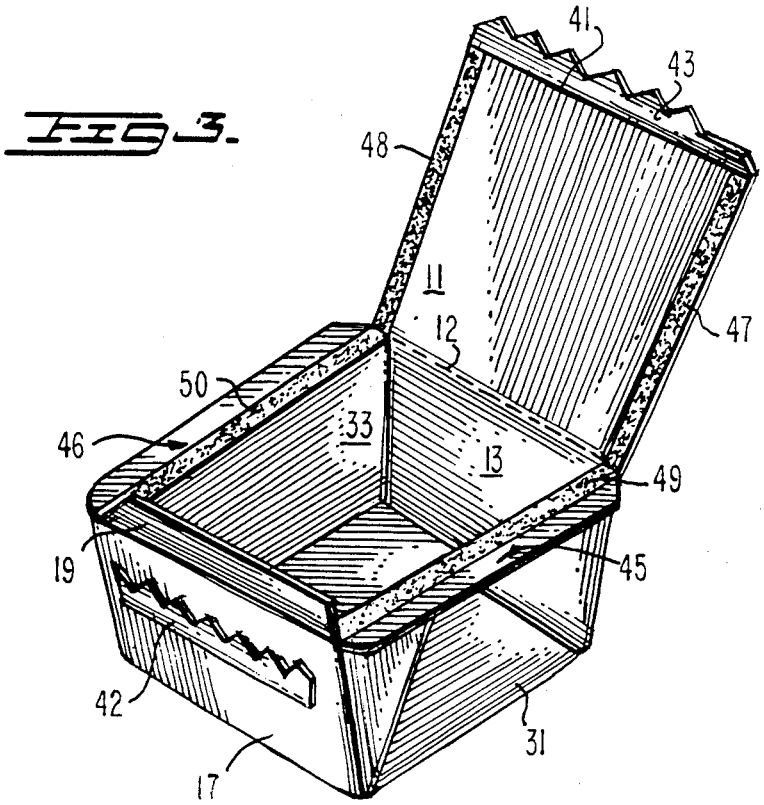

A preferred embodiment of the present invention is illustrated in FIGS. 2 and 3 wherein there is shown a tray having an integral lid 11. The tray is illustrated as having a substantially rectangular base 15, however the shape could be of any different polygonal form having multiple sides. A plurality of upstanding side walls 13, 17, 31 and 33 are shown foldably connected to the base panel 15 and each of the side walls 31 and 33 also include flange extensions 35 and 36 foldably attached to the upper edges thereof that are disposed in a plane substantially parallel to that of base panel 15. In the preferred embodiment of the present invention, the front and rear walls 17, 13 are perpendicular to the base panel 15 and the two side walls 31, 33 are angularly disposed slightly outwardly with respect to the base panel. Although all of the side walls could be arranged perpendicular to the base panel 15, the perpendicularly disposed front and rear walls 17, 13 permit the trays to be displayed with the top showing. The use of angularly disposed side walls permit the trays to be nested after being formed for storage in a minimum amount of space.

Figure 1:
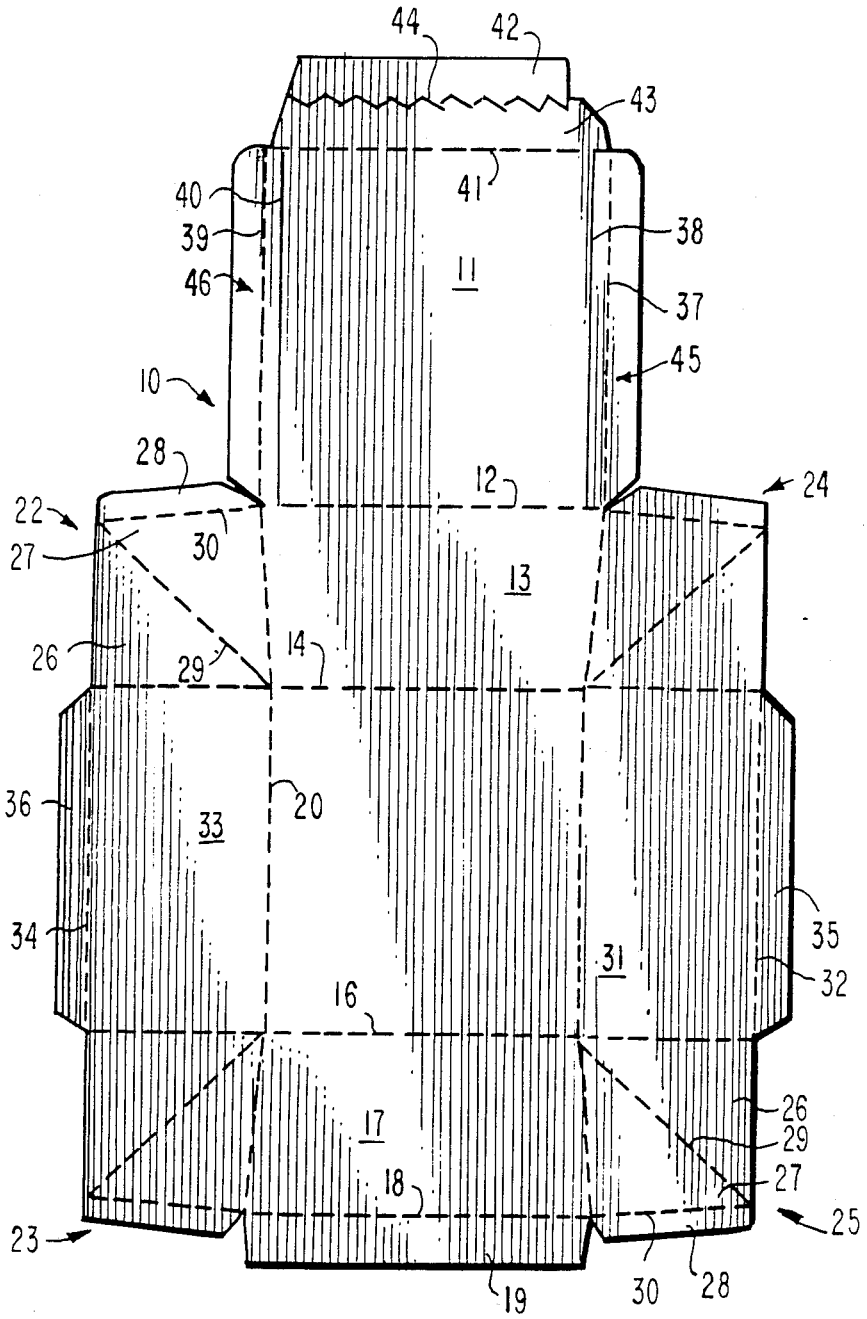
FIG. 1 is a plan view of a blank for constructing the container of the present invention.

Referring particularly to FIG. 1, it will be seen that the flange extensions 35, 36 are foldably connected to the side walls 31, 33 along score lines 32, 34 respectively. Meanwhile the side walls 31, 33 and front and rear walls 17, 13 are connected to one another by gusset panels 22, 23, 24 and 25. Each gusset panel set includes a panel 26 connected to a front or rear wall. The individual gusset panels 26, 27 at each corner are connected to one another along a diagonal score line 29, and each panel 27 includes a flange extension 28 foldably attached thereto along a score line 30. The blank 10 also includes a dust flap 19 foldably attached to the front wall 17 along a score line 18.

At the upper end of the blank of FIG. 1, the lid portion 11 is provided with extended areas 45, 46 at each side edge thereof for overlapping the flange extensions of the tray portion, and a front closure flap comprising panels 42 and 43 separated from one another by a single line of tear 44 and foldably attached to the lid along a score line 41. In addition, the lid 11 is provided with microcuts 37, 38 and 39, 40 located on the inner and outer surfaces of the lid inboard of the extended areas 45, 46 of the lid to provide a delaminatable opening for the lid.

When the container is formed, the gusset corners 22, 23, 24 and 25 are folded from the front and rear toward the side walls 31, 33 with panels 26 lying adjacent to the side walls. This folding sequence brings the panels 27 to the outside so that the flange extensions 28 become located beneath the side wall flange extensions 35, 36 where they can be bonded together with heat or adhesive, or both. The dust flap 19 is folded inside the container so that at this point, a fully set up tray is produced which is leakproof and which has no raw edges exposed to the contents. The lid 11 is of sufficient size so that the extended areas 45, 46 overlap the flange extensions 28, 35 and 36 where they are bonded in the region outside the microcuts 37, 38 and 39, 40. At the same time the portions 42 and 43 of the front closure flap are folded over and into contact with the front wall 17 where the portion 42 of the closure flap is bonded to the front wall.

FIG. 3 illustrates the open condition of the container. The first step in opening the container requires that the portions 42 and 43 of the front closure be separated along the single line of tear 44. This step frees the front part of the lid 11 for venting the container while portion 42 of the front closure remains attached to the front wall 17. Further opening of the container is achieved by lifting the lid 11. This action causes the paperboard in the region between the inner and outer microcuts 37, 38 and 39, 40 to delaminate leaving delamination areas 49 and 50 attached to the tray, and 47, 48 on the lid. At this point, the front wall dust flap 19 prevents inadvertent spillage of the contents at the front of the tray and the increased thickness of the side wall extensions 35, 36 which now include the portions 45, 46 of the lid gives the tray increased rigidity. Where it is desired to remove the lid entirely from the tray, the score line 12 separating the lid 11 from the rear wall 13 may be perforated to convert it into a line of tear.

It will thus be seen that there has been described herein a new and improved food package as well as a one piece blank for making the same. The food package of the present invention is particularly useful for preparing cooked foods in a microwave oven as well as for storing the food prior to cooking. In one possible method for using the container disclosed herein, the food itself is encased in a plastic pouch or the like and packaged in the container. When it is desired to cook the food, the pouch is opened and the contents thereof emptied into the container for cooking. Thus, even though the invention has been described in connection with a preferred embodiment, it will be understood that it is intended to cover all alternative modifications and equivalents as may be encompassed by the spirit and scope of the invention as defined in the appended claims.

What is claimed is:

1. A container for packaging, storing and cooking food consisting of an integral lid and tray comprising:

(a) a base panel:

(b) a plurality of upstanding tray walls foldably attached to said base panel along opposed score lines comprising at least two opposed side walls, a front wall and a rear wall;

(c) gusset panel closures foldably connected between the ends of said tray walls, said gusset panels being overlappingly bonded together and to said side walls;

(d) flange extensions foldably attached to the upper edges of said opposed side walls and adapted to lie in a plane substantially parallel to the plane of said base panel:

(e) a lid panel integrally attached to said rear wall along the upper edge thereof said lid including side extensions adapted to overlap and be bonded to said side wall flange extensions when the container is closed;

(f) a front wall closure flap foldably attached to the leading edge of said lid panel and adapted to be overlappingly bonded to said front wall;

(g) means in said front wall closure flap for releasing the lid from the front wall: and, (h) means in said lid panel for detachably removing said lid from said tray.

2. The container of claim 1 wherein at least one of said gusset panels at each corner of said tray includes an upper flange extension which is bonded to the underside of an adjacent side wall flange extension.

3. The container of claim 2 wherein said front wall closure flap comprises a pair of panels separated from one another along a single line of tear.

4. The container of claim 3 wherein the means in said lid panel for detachable removing said lid from said tray comprises paired microcut lines located on the inner and outer surfaces of said lid inboard of and parallel to the extended areas of said lid in the region adjacent to the bond between said lid and said side wall extensions.

5. The container of claim 4 wherein a dust flap is foldably attached to the upper edge of said front wall which is folded inside said container when the container is sealed.

6. The container of claim 5 wherein the connection between said lid and said rear wall is a line of perforations permitting complete removal of said lid from said tray.

7. The container of claim 6 wherein said side walls are angularly disposed upwardly and outwardly with respect to said base panel to permit easy stacking of said trays and said front and rear walls are disposed perpendicularly with respect to said base panel to permit the containers to be displayed with the top showing.

* * * * *